US009560714B1

(12) United States Patent
Hjerde

(10) Patent No.: US 9,560,714 B1
(45) Date of Patent: Jan. 31, 2017

(54) COLOR TEMPERATURE ADJUSTABLE, LED BASED, WHITE LIGHT SOURCE

(71) Applicant: Morten Hjerde, Nesoddtangen (NO)

(72) Inventor: Morten Hjerde, Nesoddtangen (NO)

( * ) Notice: Subject to any disclaimer, the term of this patent is extended or adjusted under 35 U.S.C. 154(b) by 0 days.

(21) Appl. No.: 15/053,732

(22) Filed: Feb. 25, 2016

(51) Int. Cl.
*H05B 33/08* (2006.01)

(52) U.S. Cl.
CPC ..... *H05B 33/086* (2013.01); *H05B 33/0845* (2013.01)

(58) Field of Classification Search
None
See application file for complete search history.

(56) References Cited

U.S. PATENT DOCUMENTS 7,972,022 B2 7/2011 Pohlert et al.
8,008,850 B2 8/2011 Su et al.
8,174,189 B2 5/2012 Kim et al.
2010/0072901 A1* 3/2010 De Rijck ..... H05B 33/0818 315/152
2011/0037081 A1 2/2011 Kuo
2011/0115406 A1* 5/2011 Wang ..... H05B 33/0812 315/294
2012/0262066 A1* 10/2012 Bakk ..... F21V 29/004 315/113

* cited by examiner

*Primary Examiner* — Dedei K Hammond
(74) *Attorney, Agent, or Firm* — r.r (princeton); Roy Rosser

(57) ABSTRACT

Assemblies of temperature monitored, semiconductor light emitting diodes (LEDs) are disclosed that produce color temperature adjustable white light sources. Warm-white LEDs are combined with green and blue LEDs to produce light have continuous spectrum spanning the wavelength range of 400 to 700 nm with a white light point located at a selectable Planckian locus location and a color rendering index greater than 80. The circuitry includes LED temperature monitoring used to adjust LEDs spectral and luminosity output. Alternate arrangements combine warm-white LEDs with green, blue and red LEDs; warm-white and cool-white LEDs with green, blue and red LEDs; warm-white and cool-white LEDs with green LEDs; and a warm-white and cool-white LEDs with green-white LEDs.

1 Claim, 5 Drawing Sheets

COLOR TEMPERATURE ADJUSTABLE, LED BASED, WHITE LIGHT SOURCE

BACKGROUND OF THE INVENTION (1) Field of the Invention

The present invention is directed to the technical field of using assemblies of semiconductor light emitting diodes (LEDs) to produce a source of white light, and more particularly to methods and systems to produce color temperature adjustable, LED based, white light sources using suitably powered, and temperature monitored, assemblies of LEDs.

(2) Description of Related Art

Human perception of an object's color results from color sensors in the eye responding to electromagnetic radiation reflected off the object. What color an object appears, therefore, depends on a combination of the reflectance spectrum of the object, the spectral distribution of light in the source illuminating the object and the spectral response of the color sensors in the human eye.

The human eye has three types of color sensors, typically called S, M and L-cones, each of which has a fairly wide spectral response but each of which is more attuned to one of red, green or blue light. There is also a fourth type of sensor, the rods, which are extremely sensitive to light and dominate in low illumination and peripheral view conditions but play an insignificant role in the high illumination, foveal vision situations in which color perception occurs. The stimuli from these sensors combine to provide the brain with the signals it perceives as colors. Human color perception is further complicated by the fact that the combination of signals from the sensors have a response that is non-linear with respect to the intensity of the illuminating light. Moreover, the brain attempts to adapt to account for the type of light illuminating an object. For example, the human brain attempts to see a green apple illuminated by daylight as being the same color green both at midday and closer to dawn or dusk, when the daylight is more yellowish and may also be less intense.

Because of these factors, the light illuminating an object is important in determining the perceived color of an object, and particularly in determining if two colors appear to match. Many people will be familiar with the problem of selecting a jacket to match a pair of black pants while indoors, only to go out into bright daylight and discover that the jacket is in fact navy blue and no longer appears the same color as the trousers.

This problem of using the correct source of light has become of great technical significance in the fields of film and television video production, particularly when scenes are filmed indoors and illuminated by artificial lighting.

The human eye has evolved viewing objects illuminated primarily by daylight. Daylight is a combination of direct radiation from the sun, and skylight, which is sunlight scattered by the atmosphere. The sun is a Planckian, or black-body, radiation source. This is a source that emits light across a broad, continuous range of wavelengths with a spectral distribution that follows Planck's law of radiation and depends only on the temperature of the light emitting body. The sun has a Planckian temperature of 5,800 K. When combined with the Rayleigh scattered sunlight from the sky, it produces a white-light that closely approximates a Planckian radiation source having a temperature of 6,500 K. The Commission Internationale de L'Eclairage (CIE), an international body that develops standards on colorimetry and illuminants, defines such light as CIE Standard Illuminant D65.

Other Planckian sources include candle flames which produce a reddish-yellow light having a color temperature of 2,000 K and tungsten incandescent lighting having a color temperature of 2,500-2,800 K.

By combining tungsten black body light emitters with appropriate filters, cinematographers are able to illuminate indoor scenes with light having the properties of daylight at various times of day, i.e. to produce light sources having color temperatures that range from 3,200 K (dusk/dawn) through 3,400 K (1 hour from dusk/dawn), 5,500 K (noon on a clear day), 6,500 K (noon on an overcast day) to 9,000 to 12,000 K (blue sky).

All light sources may be defined as having a "white point". This is a pair of chromaticity coordinates that may be used to represent the spectrum, or profile, of the light it emits. The white point may, for instance, be obtained by first normalizing the intensity of the light source's profile, then calculating the degree to which each of the three cones of the eye would be stimulated by that profile. These three values, the so-called tri-stimulus values, may then be used to obtain xy values on a CIE defined normalized, two axis chromaticity diagram.

These white light sources produced by filtered tungsten light may closely resemble light from a Planckian source, and the positions on the CIE chromaticity diagram given by the xy values of their white points form a curve that is termed the Planckian locus.

Other artificial light sources such as fluorescent lights emit light more efficiently than tungsten filament lamps. However, they have spectral distributions that differ significantly from black body radiation. Their white points typically do not lie on the Planckian locus, but they may be characterized as having correlated color temperature (CCT). This is the point on the Planckian locus that is joined to their white point by a straight line drawn normal to the Planckian locus.

Florescent lights are available that have correlated color temperatures (CCT) in a range of 2,900 K, termed a warm-white florescent light, to about 4,300 K, termed a cool-white florescent light. Colors that appear to match under, for instance a warm-white florescent light may not match under a D65 conditions, or under a cool-white florescent lamp.

In trying to characterize and account for these non-Planckian light sources, the CIE developed a Color Rendering Index (CRI) that further characterizes light sources. A light source's CRI is a measure of how closely an object's color as seen illuminated by that light source appears to match the color of that object when illuminated by a D65 light source, i.e., daylight at noon on an overcast day. A D65 light source, therefore has a perfect CRI of 100. The CIE has developed standard sets of colored materials that are used in comparing light sources and calculating their CRI.

Semi-conductor light emitting diodes (LEDs) have emerged over the last few decades as even more efficient and adaptable sources of light. LEDs typically have narrow spectral bands. However, white light can be produced from these relatively monochromatic LED's by, for instance, combining a red LED, a green LED and a blue LED. Such sources may be characterized by a combination of their white point and their CRI.

Although a white light made by combining the output of three separate color LEDs may be adjusted to have a white point at any chosen CCT without the need for additional filters, and even for that white point to lie on the Planckian locus, its CRI is likely to be very poor because of the gaps in the light spectrum between the narrow bands of light emitted by the separate colored LEDs.

Another method of producing white-light sources using LEDs is to combine an LED with a phosphor. Because of the broader spectral output of the LED induced phosphorescence, the CRI of such a white light may be considerably improved, but the CCT is now more dependent on the phosphor and may be difficult to tailor to a specific need.

The technical problem is, therefore, how to combine LEDs to produce, preferably without the need for filters, white light having both a predetermined, adjustable CCT that remains stable once selected, and a high CRI while being reasonably efficient, relatively easy to construct and to be affordable.

The relevant prior art includes:

U.S. Pat. No. 8,174,189 issued to Kim et al. on May 8, 2012 entitled "White LED device capable of adjusting correlated color temperature" that describes a white Light Emitting Diode (LED) device that enables the adjustment of a Correlated Color temperature to realize emotional illumination. The white LED device includes a package body for accommodating a plurality of light source units; a first light source unit accommodated in the package body, configured to have one or more first LED chips and a first phosphor, and configured to emit white light having a first Correlated Color Temperature (CCT); a second light source unit accommodated in the package body, configured to have one or more second LED chips and a second phosphor, and configured to emit white light having a second CCT; and a current control unit for varying current, to be supplied to at least one of the first and second LED chips, so as to adjust the first and second CCTs.

U.S. Pat. No. 8,008,850 issued to Su et al. on Aug. 30, 2011 entitled "Color temperature tunable white light emitting device" that describes a color temperature tunable white light emitting device, including a substrate with an ultraviolet light emitting diode, a purple light emitting diode, and a blue light emitting diode provided over the substrate. The UV LED, the purple LED and the blue LED are coated with a phosphor layer. An omnidirectional reflector is disposed over the phosphor layer. A medium layer is disposed between the omni-directional reflector and the phosphor layer. A transparent substrate is disposed over the omnidirectional reflector and an optical diffuser is disposed over the transparent substrate.

US Patent Application 20110037081 by Wu-Cheng Kuo et al. published on Feb. 17, 2011 entitled "White Light-Emitting Diode Packages with Tunable Color Temperature" that describes a white light-emitting diode package with tunable color temperature, including a package substrate with a first light emitting diode (first LED) disposed over a first portion of the substrate and a second light emitting diode (second LED) disposed over a second portion different from the first portion of the substrate. A phosphor layer is coated around the first and second LED, wherein the phosphor layer is formed by blending at least one colored phosphor grain with a transparent optical resin, and the at least one colored phosphor grain in the transparent optical resin is excited by light from the first and second LED to react and emit white light. In one embodiment, the first and second LED are both blue LEDs for emitting blue light of different wavelengths or ultraviolet (UV) LEDs for emitting UV light of different wavelengths.

U.S. Pat. No. 7,972,022 issued to Pohlert et al. on Jul. 5, 2011 "Stand-mounted light panel for natural illumination in film, television or video" that describes a lighting apparatus comprises a light panel having a panel frame, and a plurality of LEDs or other light elements secured to the panel frame. A self-contained battery unit securably attaches to the outside of the panel frame. The light panel may have a dimmer switch, and may also be capable of receiving power from a source other than the self-contained battery unit. The lighting apparatus can be mounted to a camera or a stand through adapters. Diffusion lenses or color gels can be integrated with or detachable from the light panel. The lighting apparatus may conveniently be provided in the form of a kit, with one or more of a light panel, self-contained battery unit, compact stand, connecting cable(s), adapter(s), lenses or color gels, and so on, provided in a single package.

Various implementations are known in the art, but fail to address all of the problems solved by the invention described herein. Various embodiments of this invention are illustrated in the accompanying drawings and will be described in more detail herein below.

BRIEF SUMMARY OF THE INVENTION

Inventive systems and methods of providing a color temperature adjustable, semiconductor, light emitting diode (LED) based, white light source are disclosed.

In a preferred embodiment of the present invention, one or more warm-white LEDs may be combined with one or more green LEDs and one or more blue LEDs to produce a light source emitting light have continuous spectrum spanning at least the wavelength range of 400 to 700 nm with a white light point located at a selectable Planckian locus location and having a color rendering index greater than 80.

This may, for instance, be accomplished by calculating a required luminous flux of each of the green, blue and warm-white LEDs such that their combined emitted light provides the required spectral output. As the spectral emission of LEDs may be temperature dependent, the power supply circuitry of the present invention may include devices for measuring the temperature of one of more of the LEDs. This temperature determination may be used to calculate an amount of electrical power required by each of the LED's to provide the required luminous flux, which may then be supplied to each of the LEDs.

In alternate embodiments of the present invention, alternate arrangements of white and colored LEDs may be combined to produce the required color temperature adjustable, LED based, white light source. These may, for instance, include combinations such as, but not limited to, warm-white LEDs combined with green LEDs, blue LEDs and red LEDs; warm-white LEDs and cool-white LEDs combined with green LED, blue LEDs and red LEDs; warm-white LEDs and cool-white LEDs combined with green LEDs; and a combination warm-white LEDs, cool-white LEDs and green-white LEDs.

Therefore, the present invention succeeds in conferring the following, and others not mentioned, desirable and useful benefits and objectives.

It is an object of the present invention to provide a system and method for providing LED based white light sources for use in situations such as, but not limited to, lighting studios for film and video recording, for architectural lighting, for photographic studio special effects or some combination thereof.

It is another object of the present invention to provide LED white light sources having a stable, selectable Planckian locus location color temperatures for use in situations such as, but not limited to, video and photographic lighting to achieve desired visual effects. It is yet a further objective of the present to invention to provide white light sources having both a predetermined, stable CCT and a high CRI while being reasonably efficient, relatively easy to construct and to be affordable, and have no need of additional filters.

BRIEF DESCRIPTION OF THE SEVERAL VIEWS OF THE DRAWINGS

FIG. 2 B shows an exemplary plot of a spectral output of an LED white light source.

DETAILED DESCRIPTION OF THE INVENTION

Figure 1:
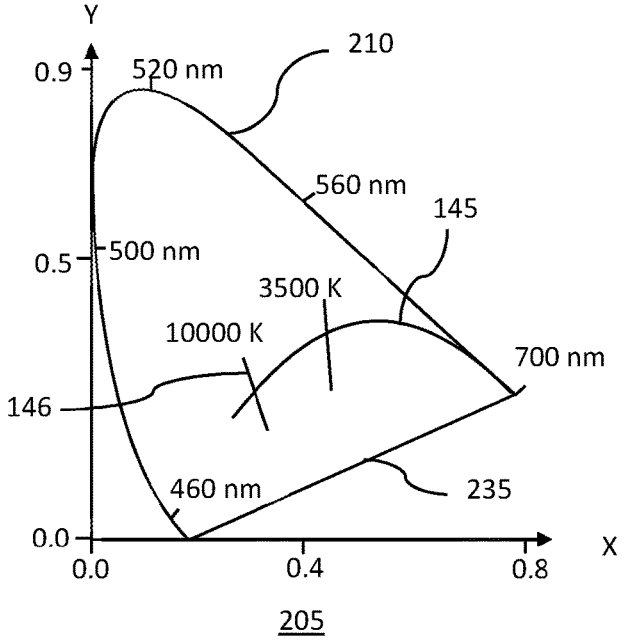
FIG. 1 shows a schematic diagram of a color space chromaticity diagram.

The preferred embodiments of the present invention will now be described in more detail with reference to the drawings in which identical elements in the various figures are, as far as possible, identified with the same reference numerals. These embodiments are provided by way of explanation of the present invention, which is not, however, intended to be limited thereto. Those of ordinary skill in the art may appreciate upon reading the present specification and viewing the present drawings that various modifications and variations may be made thereto without deviating from the spirit or intent of the present invention.

FIG. 1 shows a schematic diagram of a color space, chromaticity diagram 205. The color space chromaticity diagram 205 is a method of representing a quantitative link between the colors of the visible electromagnetic spectrum as defined by their wavelength and the physiological colors perceived by the human eye and brain. Initially created by the International Commission on Illumination (CIE) in 1931 based on experimental results, the CIE 1931 color space separates the chromaticity of a color from its brightness, or luminance. At a constant brightness, a color's chromaticity may, therefore, be represented by two parameters in a CIE xy chromaticity diagram.

The spectral locus 210 of the color space chromaticity diagram 205 may enclose the entire gamut of colors sensed by an average human being, or CIE standard observer, and is typically marked in the wavelength in nm of pure electromagnetic radiation that exhibits the xy response at the marked locus point. The xy coordinates may be linked to the stimulated response in an observer's eye's three color sensors by a well-known set of mathematical formula.

The base of the spectral locus 210 is the line of purples 235. The line of purples 235 does not correspond to any pure spectral colors but may represent the average human, or CIE standard observer, response to a mixture of pure 700 nm wavelength red and pure 700 nm blue light.

A Planckian locus 145 may be contained within the spectral locus 210 of the color space chromaticity diagram 205. The Planckian, or black body, locus 145 represents the human response to pure white light as produced by a heated black-body radiator emitting light. The Planckian locus 145 may be marked in terms of the temperature, in degrees Kelvin, of the heated, black-body radiator emitting the white light.

An ideal Planckian, or black-body, radiator emits light having a continuous spectrum shaped according to Planck's law of radiation, the spectral distribution of which depends only on the temperature to which the black-body is heated. Light emitted by black-body radiators is typically perceived as being white light, but with different degrees of warmth. Confusingly, white light from a very hot black-body radiator, of the order of 9000 K or so, may appear to have a blueish tint and may be described as a cold white light, whereas the white light from emitted by a less hot black body, having a temperature of the order of 3000 K, may appear yellowish and is typically described as being a warmer white light.

The correlated color temperature of a specific, or test, light source may be described as the temperature of the Planckian radiator under which a color sample may be perceived as most closely resembling that same color sample seen under the test light source. These may, for instance, be represented by lines of constant correlated color 146 that may be drawn perpendicular to the Planckian locus 145, passing through it at the appropriate Planckian color/temperature location.

Figure 2A:
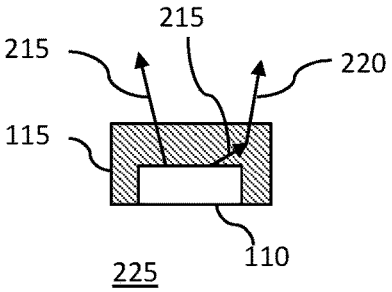
FIG. 2 A shows a schematic, X-sectional view of a LED based white light source.
Figure 2B:
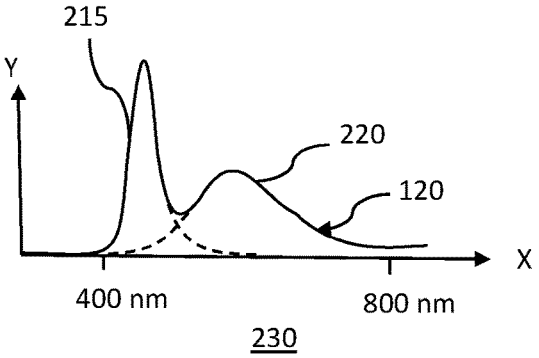

FIG. 2 A shows a schematic, X-sectional view of a LED based white light source 225. The LED based white light source 225 may, for instance, be constructed using a semiconductor light emitting diode (LED) 110 and a phosphor coating 115.

The LED emitted light 215 may have a narrow spectral range. Some of the LED emitted light 215 may pass through the phosphor, while a portion of it may interact with the phosphor to produce LED induced phosphorescence 220. The LED induced phosphorescence 220 typically has a broad, continuous spectral output.

An advantage of LED-based lighting sources is their good luminous efficacy. White LEDs, such as newer variant of those made by Cree, Inc. of Durham, N.C., typically have a luminous efficacy of 80-100 lumens per watt (lm/W) compared to about 50 lm/W for conventional incandescent lighting. Red LEDs are available with efficiencies greater than the 100 lm/W of standard fluorescent lighting.

FIG. 2 B shows an exemplary plot of a spectral output of an LED white light source 230 with the Y axis representing the intensity of emitted light and the X axis representing the wavelength of light in nanometers.

The spectral output 230 of an LED based white light source may, for instance, be a combination of light from an LED emitted light 215 and a LED induced phosphorescence 220 that combine together to produce a continuous spectral output 120.

In the illustration of FIG. 2 B, the LED emits blue light in a region of 400 nm while the phosphorous may be a yellow phosphorous with light emission that peaks towards the red end of the visible light spectrum but that provides continuous light emission in the range from around 400 nm to beyond 800 nm.

Figure 3:
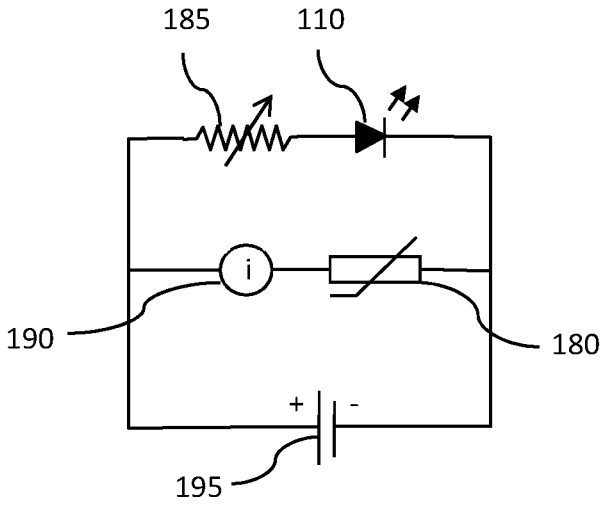
FIG. 3 shows an exemplary circuit diagram of a temperature monitored LED light source.

FIG. 3 shows an exemplary circuit diagram of a temperature monitored LED light source.

The light emitting diode 110 may, for instance, be a P-N semiconductor junction that, when an electric current is passed through it, may emit light via a process called electroluminescence. The amount of light emitted is typically proportional to the current flowing through the light emitting diode 110.

The voltage and current supplied to the light emitting diode 110 from an electrical power source 195 may, for instance, be controlled via a device such as, but not limited to, a variable resistor 185.

The spectral output of the light emitting diode 110 may, for instance, be dependent on the temperature at which the LED is operating. In a preferred embodiment of the present invention the temperature of the diodes may be monitored by devices such as, but not limited to, a thermistor 180 and an amp meter 190.

Thermistors may, for instance, be made of ceramic or polymers. They typically achieve a greater precision of temperature measurement within a limited temperature range, typically −90° C. to 130° C. than metal, or pure metal, resistance temperature detectors (RTDs).

The amp meter 190 may, for instance, be in the form of one or more electronic circuit elements that may be used with the variable resistor 185 to control the current flow through the light emitting diode 110 and hence the intensity and spectral makeup of the light emission from the LED. The amp meter 190 may also, or instead, be a circuit designed to obtain data concerning the thermistor 180 and hence information concerning the ambient temperature in a vicinity of one or more light emitting diodes. This temperature information may, for instance, be used to calculate the anticipated intensity and spectral makeup of light being emitted by one or more light emitting diodes 110.

Figure 4:
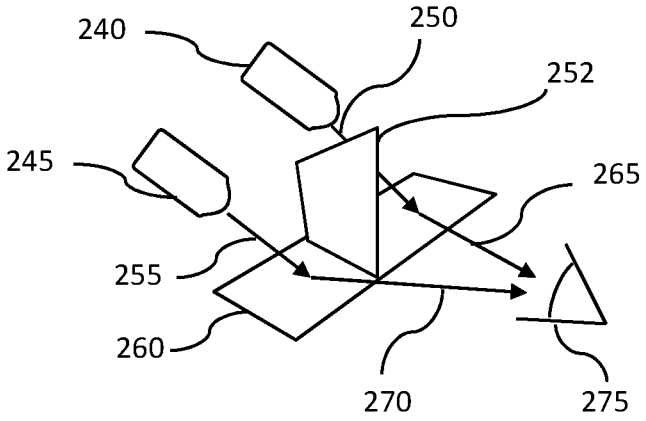
FIG. 4 shows a schematic, isometric view of an exemplary method of determining a color rendering index.

FIG. 4 shows a schematic, isometric view of an exemplary method of determining a color rendering index.

A Color Rendering Index (CRI) of a source of illumination is intended to indicate how accurately a color of an object is perceived when that object is viewed illuminated by that illuminant. In particularly, it is a measure of how similar an object's color appears when viewed under a standard illuminant compared to when it is viewed under that source of illumination. Daylight, typically daylight consisting of a combination of direct sunlight and Rayleigh refracted skylight having a color temperature of 6,500 K, may be considered to be an ideal, or reference source, and has a CRI value of 100. Other sources may be judged against the reference source by observing an array of standard colored objects under the source being tested and the reference source. The results may be combined and expressed as a number that may be an overall percentage of color rendering accuracy. The Commission Internationale de L'Eclairage (CIE), is an international body based in Vienna, Austria, that develops standards and protocols for color matching that cover both the detailed requirements of the reference illuminants and the sets of colored objects to be used in assessing the CRI of light sources.

In FIG. 4, a colored sample 260 is shown as being illuminated by both a light source being tested 245 and a reference light source 240. The light 255 emitted by the light source being tested and the light 250 emitted by the reference light source are both shown being reflected off the colored sample 260. For illustrative purposes, the light from the two sources is shown separated by a light separating shield 252. The light 270 from the light source being tested reflected by the colored sample and the light 265 from the reference light source reflected by the colored sample may then both be incident on an observer 275. The observer 275 may then make a judgement as to how similar the color of the colored sample 260 appears when illuminated by the different sources. By repeating the procedure on a number of carefully, experimentally selected samples, and overall figure may be determined that provides an indication of how well color matching under the light source being tested 245 compares with color matching under a reference light source 240. This overall figure may then be expressed as the color rendering index (CRI) of the test source.

Although the observer 275 may be a human observer, it may also be an item of technical equipment designed to perform quantified color measurements such as, but not limited to, a UV-VIS spectrophotometer.

Figure 5:
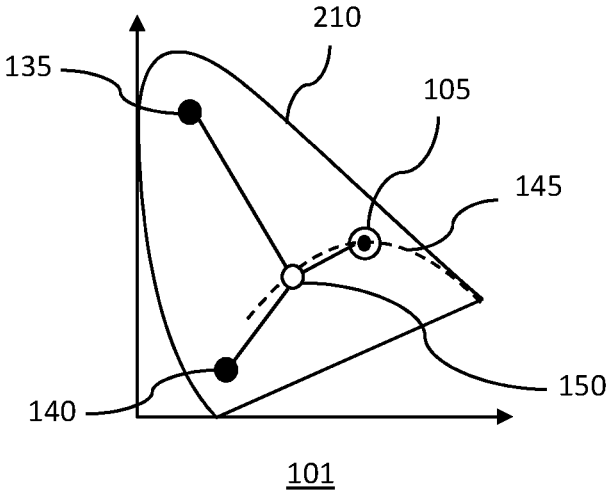
FIG. 5 shows a schematic representation of a color temperature adjustable, LED based, white light source of a first exemplary embodiment of the present invention.

FIG. 5 shows a schematic representation of a color temperature adjustable, LED based, white light source 101 of a first exemplary embodiment of the present invention.

The color temperature adjustable, LED based, white light source 101 shown in FIG. 5 may be made up of a warm-white LED 105, a green LED 135 and a blue LED 140, the combined light emission of which provides a source having a white light point 150 that may lie on the Planckian locus 145. The respective sources are shown within the spectral locus 210 of a standard a color space, chromaticity diagram.

In a preferred embodiment, the color temperature adjustable, LED based, white light source 101 of the embodiment of FIG. 5 may be made up of an array or combination of three varieties of LEDs.

The first variety may be a warm-white LED 105 that may be a combination a light emitting diode and a phosphor coating combined to emit light having a continuous spectral output spanning at least a wavelength range of 400 nm to 700 nm and having a correlated color temperature 130 of 3500 K or less.

The second variety may be a green LED 135 emitting light having a peak emission wavelength in a range of 500 nm to 540 nm.

The third variety may be a blue LED 140 emitting light having a peak emission wavelength in a range of 400 nm to 490 nm.

By using reference data that may be experimental data, or theoretical data, or a combination thereof, a required luminous flux of each of the green, blue and warm-white LEDs may be calculated by, for instance, using software operative on a data processing device, so that their combined emitted light may provide a color temperature adjustable, white light source having a continuous spectrum spanning at least the wavelength range of 400 to 700 nm and with a white light point 150 at a predetermined position on the Planckian locus 145 location and with a color rendering index greater than 70, and in a more preferred embodiment a CRI greater than 80, and in an even more preferred embodiment a CRI greater than 90.

In a preferred embodiment, the color temperature adjustable, LED based, white light source may further include a device such as, but not limited to, a thermistor, for measuring the temperature of one or more of the LEDs in the device.

Using reference data, and the temperature data, an amount of electrical power required by each of the LED's to provide the required luminous flux may be calculated or inferred, and the required amount of electrical power to may then be supplied to each of the LEDs to obtain the required color temperature adjustable, LED based, white light source having its pre-selected, required characteristics. This supply of appropriate electrical power may, for instance, be mediated by calculation or by the design of electronic circuitry, or by some combination thereof.

An advantage of this embodiment is that the use of a white phosphor converted LED in place of a red LED to produce the required white light may mitigate thermal runaway of a red LED. Red LEDs are typically manufactured using AlGaInP. The luminous flux from this material typically drops faster with rising temperature than that of typical green or blue LEDs. When using a red LED as a component in a white light source, it may need to be driven harder, i.e., supplied with more current, in order to provide the necessary brightness and so help maintain a stable color temperature stable. In doing so, the LED may generate more heat which may leads to thermal runaway. Having a low color temperature, phosphor converted LED instead of a red LED may be one way to mitigate the problem.

Advantages of the embodiment of FIG. 5 include that it may be less dependent on LED production tolerances and that it may provide a good CRI.

Although the warm-white LED 105 is shown in FIG. 5 as lying on the Planckian locus 145, one of ordinary skill in the art will appreciate that its white point may be off the Planckian locus without unduly altering the performance of such a device.

Figure 6:
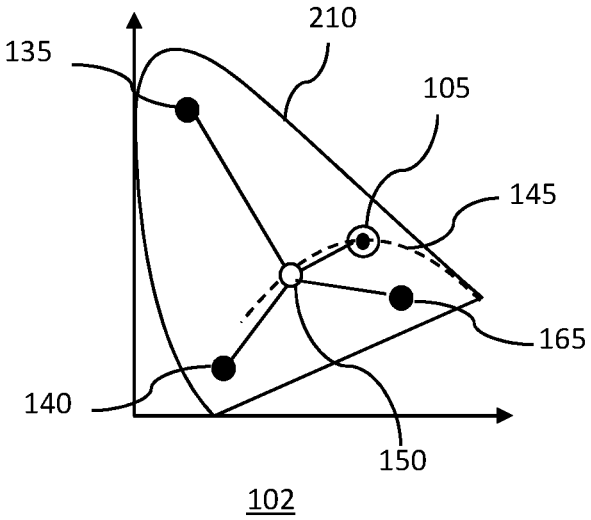
FIG. 6 shows a schematic representation of a color temperature adjustable, LED based, white light source of a second exemplary embodiment of the present invention.

FIG. 6 shows a schematic representation of a color temperature adjustable, LED based, white light source 102 of a second exemplary embodiment of the present invention.

The embodiment of FIG. 6 differs from that of FIG. 5 in having an additional variety of LED, a red LED 165 in addition to the warm-white LED 105, the green LED 135 and the blue LED 140 that together produce the color temperature adjustable, LED based, white light source 102 having a white light point 150 on the Planckian locus 145, representative locations of which of shown within a spectral locus 210 of a standard a color space, chromaticity diagram.

In this embodiment, the red LED 165 emitting light may have a peak emission wavelength in a range of 580 nm to 700 nm. The calculation of the required final luminous flux and color temperature may now require consideration of each of the red, green, blue and warm white varieties of LEDs with in an array, as may the temperature compensated adjustments of their power requirements.

In this embodiment, the math required to calculate the values for the four emitters is non-trivial as four emitters typically represent an underdetermined problem, though good results may be obtained using techniques such as, but not limited to, Gaussian elimination and reduction.

Although the warm-white LED 105 is shown in FIG. 6 as lying on the Planckian locus 145, it is not necessary for it to be on the locus. It also does not need to be a warm white LED and may have any CCT.

Advantages of this embodiment include that it has a wide color gamut, emitting colors over a large portion of the color spectrum, as well as that it does not depend on close LED production tolerances, it has a high CRI and its efficacy is relatively high. A further advantage of having a red LED is that it allows for a CCT lower than that of the white LED, and may also enable a higher CRI as red emission tends to be a weak point of phosphors white light.

Figure 7:
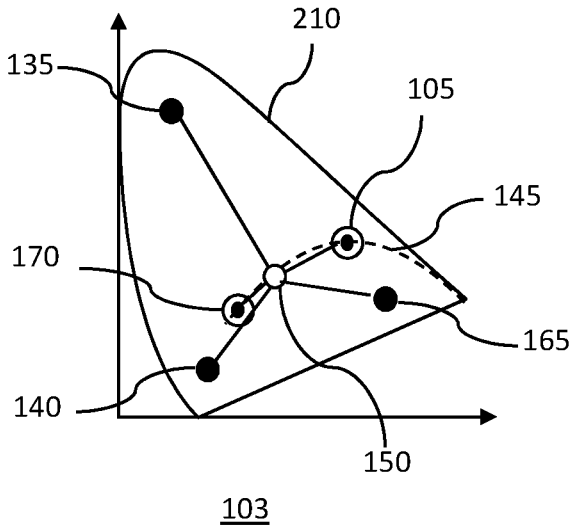
FIG. 7 shows a schematic representation of a color temperature adjustable, LED based, white light source of a third exemplary embodiment of the present invention.

FIG. 7 shows a schematic representation of a color temperature adjustable, LED based, white light source 103 of a third exemplary embodiment of the present invention.

This embodiment of the invention differs from that shown in FIG. 6 in that there is also a cool-white LED 170. This embodiment, therefore, may incorporate a cool-white LED 170, a warm-white LED 105, a red LED 165, a green LED 135 and a blue LED 140 that combine to form a color temperature adjustable, LED based, white light source 102 having a white light point 150 lying on the Planckian locus 145. These respective sources are shown schematically within the spectral locus 210 of a standard a color space, chromaticity diagram.

The cool-white LED 170, may, for instance, be a cool white LED make from a light emitting diode and a phosphor coating combined to emit light having a continuous spectral output spanning at least the wavelength range of 400 nm to 700 nm and having a correlated color temperature greater than 3500 K.

The calculation of the required final luminous flux and color temperature may now require consideration of each of red, green, blue, warm-white and cool-white varieties of LEDs within an array, as may the temperature compensated adjustments of their power requirements.

This embodiment of the invention may achieve a full color spectrum and a high CRI white. This embodiment may require a microprocessor functionally connected to the LED temperature monitoring and current supply electronics so as to calculate the required color transformation math for selected illumination CCT. Advantages of this embodiment may be that it is produces an illumination having a wide gamut, i.e., a full color spectrum, and that the CRI is high over the entire range of selectable CCT white spots.

Although the cool-white LED 170 and the warm-white LED 105 are both shown in FIG. 7 as lying on the Planckian locus 145, one of ordinary skill in the art will appreciate that it is not necessary for either of them to lie on the locus for the device of this embodiment to be effective.

Figure 8:
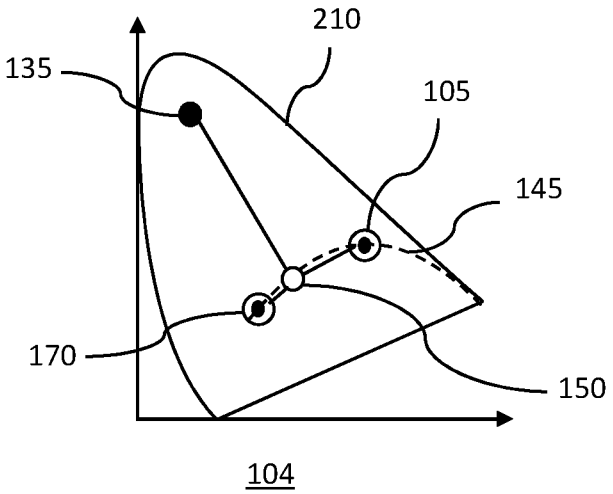
FIG. 8 shows a schematic representation of a color temperature adjustable, LED based, white light source of a fourth exemplary embodiment of the present invention.

FIG. 8 shows a schematic representation of a color temperature adjustable, LED based, white light source 104 of a fourth exemplary embodiment of the present invention.

This embodiment differs from the embodiment shown in FIG. 5 in that the blue LED has been replaced by a cool-white LED 170. The color temperature adjustable, LED based, white light source 104 of this fourth exemplary embodiment of the present invention is, therefore, made up of an array having a warm-white LED 105, a green LED 135 and a cool-white LED 170 that together produce a white light source having a white light point 150 located on the Planckian locus 145. These respective sources are shown schematically within the spectral locus 210 of a standard a color space, chromaticity diagram.

The cool-white LED 170 may, for instance, be accomplished by adding a phosphor coating to the blue LED thereby providing a cool-white LED emitting light having a continuous spectral output spanning at least the wavelength range of 400 nm to 700 nm and having a correlated color temperature greater than 3500 K.

The calculation of the required final luminous flux and color temperature may now require consideration of each of green, warm-white and cool-white varieties of LEDs within an array, as may the temperature compensated adjustments of their power requirements.

This embodiment of the invention may use the green LED 135 to pull the CCT in line with the Planckian locus, resulting in white light with high efficacy and high CRI over the full range of CCT and which is not dependent on close production tolerances for the LEDs.

Figure 9:
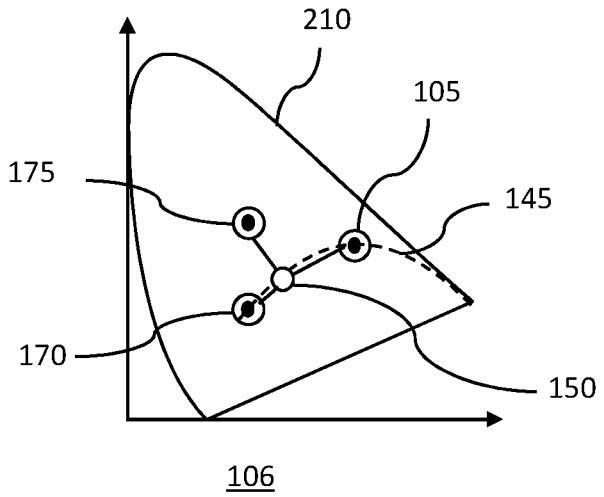
FIG. 9 shows a schematic representation of a color temperature adjustable, LED based, white light source of a fifth exemplary embodiment of the present invention.

FIG. 9 shows a schematic representation of a color temperature adjustable, LED based, white light source of a fifth exemplary embodiment of the present invention.

This embodiment of the invention differs from that shown in FIG. 8 in that the green LED has been replaced by a green-white LED 175.

The color temperature adjustable, LED based, white light source 106 of a fifth exemplary embodiment of the present invention, therefore, is made up of an array that include a warm-white LED 105, a green-white LED 175 and a cool-white LED 170 that together produce a white light source have a white light point 150 located on the Planckian locus 145. These respective sources are shown schematically within the spectral locus 210 of a standard a color space, chromaticity diagram.

Although the warm-white LED 105 and the cool-white LED 170 are shown schematically in FIG. 9 as lying on the Planckian locus 145, one of ordinary skill in the art will appreciate that they may be located off the Planckian locus 145 and may still be used to produce the desired output light.

The green-white LED 175 may, for instance, be provided by adding a phosphor coating to a green light LED thereby providing a green-white LED 175 emitting a green-white light having a continuous spectral output spanning at least the wavelength range of 400 nm to 700 nm and having a white light point located above the Planckian locus location and correlated color temperature in a range of 2500 K to 5500 K.

The calculation of the required final luminous flux and color temperature may now require consideration of each of the green-white, warm-white and cool-white varieties of LEDs within an array, as may the temperature compensated adjustments of their power requirements.

This embodiment may have advantages that include high efficiency and a high CRI over the entire range of selectable CCTs, as well as that optical color mixing may be greatly simplified.

The performance of the color temperature adjustable, LED based, white light sources described above has included quantifying them by their CRI. An alternate, but related measure of illuminants performance in reproducing, or rendering, colors that may also or instead be used is their color gamut area. The color gamut area may, for instance, be defined as the area within area enclosed within three or more chromaticity coordinates in a given color space. For purposes of color rendering, the gamut area is usually calculated from the area of the polygon defined by the chromaticities of the eight CIE standard color samples, the same reference samples used to calculate color rendering index (CRI) in CIE 1976 color space when illuminated by a given light source. A measure of a light source's color matching capability may, for instance, be defined as the ratio of the source color gamut area with respect to the color gamut area of a reference illumination source such as, but not limited to, a tungsten incandescent lamp of known CCT. The closer such a ratio to 1, the better the light source may be assumed to be for the purposes of color matching.

The calculation of the required final luminous flux and color temperature may in the examples above may be performed mathematically using a variety of methods.

If there are three LEDs, and their emission peaks or their white points, defined in terms of their CIE x, y chromaticity values, and the required x, y chromaticity of the desired output light is known, the calculation may be relatively straight forward.

First, the coordinates of the desired output must lie on or within the triangle joining the x,y chromaticity values of the three contributing sources. If that is satisfied, a set if linear equations may then be set up relating the intensity required by each of the three LEDs to provide the required output. As it is only the ratio of intensities that are required, one of the intensity may arbitrarily be set to unity, so that there are then two equations with two unknowns, which is easily solved.

For instance, for three LEDs termed A, B and C the required output chromaticity x value, represented by the symbol $X_O$, may be obtained from the following calculation in which the symbol $I_A$ stands for the intensity of the light source A, and the symbol $X_A$ for the x value of light source A. The corresponding values for the other two sources are identified in a similar manner by their corresponding subscripts, B and C.

The resultant or output x chromaticity values may simply be the sum of the products of each sources x chromaticity multiplied by that sources intensity, all averaged by the sum of the source intensities, as represented in equation 1 below:

$$X_O=(I_A \cdot X_A+I_B \cdot X_B+I_C \cdot X_C)/(I_A+I_B+I_C) \quad (1)$$

This may be rearranged to the following form:

$$I_A(X_A-X_O)+I_B(X_B-X_O)+I_C(X_C-X_O)=0 \quad (2)$$

The same may be done for the y values to yield:

$$I_A(Y_A-Y_O)+I_B(Y_B-Y_O)+I_C(Y_C-Y_O)=0 \quad (3)$$

To obtain the ratios of the required currents, assume $I_A=1$, resulting in the following two equations, in which the only unknowns are the two values, $I_B$ and $I_C$.

$$I_B(X_B-X_O)+I_C(X_C-X_O)=X_O-X_A \quad (4)$$

$$I_B(Y_B-Y_O)+I_C(Y_C-Y_O)=Y_O-Y_A \quad (5)$$

Having two equations and two unknowns means that they can always be solved to yield two unique results. However, once there are four or more LEDs, there are more unknowns than equations and a set of underdetermined linear equations results that may, or may not, have a solution.

A standard method of dealing with a set of underdetermined linear equations may be to represent the linear equations as a matrix. Using well-known techniques, the matrix may then be reduced to row-echelon form by, for instance, using Gaussian reduction, and the rank of the coefficient matrix and of the augmented matrix may be obtained, as detailed in standard mathematical texts. If the rank of the coefficient and the augmented matrixes are equal, it is well-know that there are solutions to the linear equations. If they are, however, not, equal the linear equations are said to be inconsistent, and there is no solution.

There may still a problem even if the set of underdetermined linear equations representative of the CIE x, y chromaticity values is consistent, because there are generally an infinite number of solutions. The question then is what sort of constraint to place on the solutions in order to find a unique set of solutions.

In a preferred embodiment of the present invention, a solution may be to implement computer software to automatically establish a set of underdetermined, but consistent, linear equations representative of the CIE x, y chromaticity values of the four or more LEDs.

Software modules may then be used to automatically use Gaussian reduction techniques to solve the equations to the extent of finding a ratio of currents required by three of the LEDs. The ratio of currents of the remaining LEDs may then be determined by using a constraint such as, but not limited to, automatically minimizing a mean square variation of the luminous flux of the LEDs over a particular wavelength range, preferably over a wavelength range representative of the full gamut of visible colors, such as, but not limited to, over a wavelength range of 400 to 700 nm.

However, such calculations may be computationally expensive and may not be easily amiable to intuitive optimization for circumstances such as, but not limited to, factoring in costs of particular LEDs, temperature stability of particular LEDs, or power consumption costs of particular LEDs, or some combination thereof.

Figure 10:
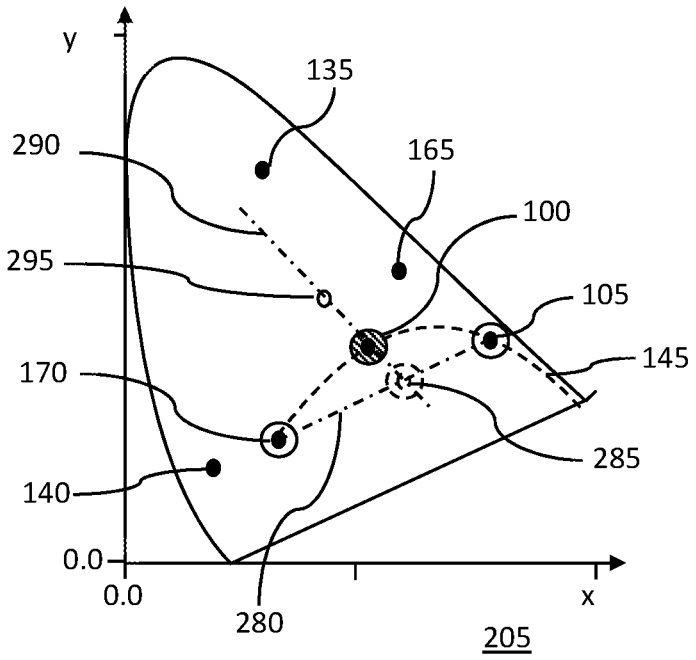
FIG. 10 shows a combined color temperature adjustable, LED based, white light source made up of five LEDs, namely a cool-white LED, a warm-white LED, and a red, a green and a blue LED, and a method for calculating the current ratios required to achieve it.

FIG. 10 shows a combined color temperature adjustable, LED based, white light source 100 made up of five LEDs, namely a cool-white LED 170, a warm-white LED 105, and a red 165, a green and a blue LED.

Rather than attempting to calculate the required current ratios of the five LEDs by solving a set of underdetermined linear equations using the method outlined above, the following inventive method may be used.

On the color space chromaticity diagram 205 shown in FIG. 10, a line 280 joining the two white LEDs 105, 170 may first be drawn. A second line 290 may then be drawn normal to the Planckian locus 145 and through the Planckian location of the required output white source 100. A calculated, composite white LED 285 may then be determined that has x, y chromaticity coordinates of the intersection of the lines 290 and 280. A calculated, composite RGB LED 295 formed by combining the green LED 135, the blue LED 140 and the red LED 165 may then be calculated. The calculated, composite RGB LED 295 should lie on the line 290 drawn normal to the Planckian locus and through the Planckian location of the required output white source and should be approximately as far from the required white light source 100 as is the calculated, composite white LED 285, but on the other side of the Planckian locus 145.

Both the calculated, composite RGB LED 295 and the calculated, composite white LED 285 may then be treated as individual units, i.e., the ratios of their currents to each other locked and varied as a block, and the overall currents of two calculated, composite sources may then be adjusted to produce the required composite output source 100.

By breaking the problem down in this innovative manner, each step may be solved exactly using rapid calculations that may readily be made available as software routines, or software modules, and may be implemented to run on a microprocessor.

Although the method is shown above for a situation in which the white light LEDs are located on the Planckian locus 145, one of ordinary skill in the art will appreciate that the method may be applied more generally, and may be independent of any of the sources, including the output source, lying on the Planckian locus 145. Moreover, the approach of treating two or three sources as a block may be a way of reducing the complexity of the calculation in a variety of similar arrangements of LEDs.

Although this invention has been described with a certain degree of particularity, it is to be understood that the present disclosure has been made only by way of illustration and that numerous changes in the details of construction and arrangement of parts may be resorted to without departing from the spirit and the scope of the invention.

The invention claimed is:

1. A method of providing a color temperature adjustable, LED based, white light source, comprising:

providing a warm-white LED, said warm-white LED comprising a light emitting diode and a phosphor coating combined to emit light having a continuous spectral output spanning at least a wavelength range of 400 nm to 700 nm and having a correlated color temperature of 3500 K or less;

providing a green LED emitting light having a peak emission wavelength in a range of 500 nm to 540 nm;

providing a blue LED emitting light having a peak emission wavelength in a range of 400 nm to 490 nm;

providing a red LED emitting light having a peak emission wavelength in a range of 580 nm to 700 nm;

calculating a required luminous flux of each of said red, green, blue and warm white LEDs such that a combined output of said LED's provides said color temperature adjustable white light source, and wherein said color temperature adjustable white light source emits light having a continuous spectrum spanning at least the wavelength range of 400 to 700 nm and has a white light point at a required Planckian locus location and a color rendering index greater than 80;

measuring a temperature of each of said LEDs;

calculating an amount of electrical power required by each of said LED's to provide said required luminous fluxes, said calculating comprising:

automatically establishing a set of underdetermined, but consistent, linear equations representative of the CIE x, y chromaticity values of said red, green and blue LEDs, and of the CIE x, y chromaticity value of the white-point of said warm white LED;

automatically solving, using Gaussian reduction, for a ratio of currents required by three of said LEDs;

automatically obtaining a ratio of currents required for the remaining two LEDs by applying a constraint of minimizing a mean square variation of their luminous flux over the wavelength range of 400 to 700 nm; and supplying said required amount of electrical power to each of said LEDs.

* * * * *